US009127544B2

(12) United States Patent
Dombrowski et al.

(10) Patent No.: US 9,127,544 B2
(45) Date of Patent: Sep. 8, 2015

(54) FLUID INJECTION IN LIGHT TIGHT OIL RESERVOIRS

(71) Applicant: Shell Oil Company, Houston, TX (US)

(72) Inventors: Robert James Dombrowski, Houston, TX (US); Ernesto Rafael Fonseca, Houston, TX (US); John Michael Karanikas, Houston, TX (US); Mauricio Jose Farinas Moya, Houston, TX (US); Barbara Caterina Lamantia, Katy, TX (US)

(73) Assignee: Shell Oil Company, Houston, TX (US)

( * ) Notice: Subject to any disclaimer, the term of this patent is extended or adjusted under 35 U.S.C. 154(b) by 291 days.

(21) Appl. No.: 13/781,185

(22) Filed: Feb. 28, 2013

(65) Prior Publication Data

US 2013/0228337 A1 Sep. 5, 2013

Related U.S. Application Data

(60) Provisional application No. 61/605,589, filed on Mar. 1, 2012.

(51) Int. Cl.

| | |
|---|---|
| ***E21B 43/26*** | (2006.01) |
| ***E21B 43/17*** | (2006.01) |
| ***E21B 43/16*** | (2006.01) |

(52) U.S. Cl.

CPC ..... *E21B 43/26* (2013.01); *E21B 43/168* (2013.01); *E21B 43/17* (2013.01)

(58) Field of Classification Search

CPC ..... E21B 43/17

See application file for complete search history.

(56) References Cited

U.S. PATENT DOCUMENTS

| | | | | |
|---|---|---|---|---|
| 2,862,556 | A * | 12/1958 | Tek | 166/271 |
| 3,118,499 | A * | 1/1964 | Johnson et al. | 166/271 |
| 3,938,590 | A | 2/1976 | Redford et al. | 166/270 |
| 4,440,650 | A | 4/1984 | Watson et al. | 252/8.55 |
| 4,706,750 | A | 11/1987 | Buckles | 166/271 |
| 4,889,186 | A * | 12/1989 | Hanson et al. | 166/252.1 |
| 5,025,859 | A * | 6/1991 | Hanson et al. | 166/252.1 |
| 5,131,471 | A | 7/1992 | Duerksen et al. | 166/303 |
| 5,148,869 | A | 9/1992 | Sanchez | 166/303 |
| 5,377,756 | A * | 1/1995 | Northrop et al. | 166/267 |
| 5,503,226 | A * | 4/1996 | Wadleigh | 166/252.1 |
| 2008/0087425 | A1 | 4/2008 | Hsu et al. | 166/266 |
| 2009/0038795 | A1 | 2/2009 | Kaminsky et al. | 166/266 |
| 2011/0127033 | A1* | 6/2011 | Dong | 166/272.3 |
| 2014/0054050 | A1* | 2/2014 | Lindsay et al. | 166/402 |
| 2014/0262240 | A1* | 9/2014 | Boone et al. | 166/250.01 |
| 2015/0007988 | A1* | 1/2015 | Ayasse | 166/271 |
| 2015/0007996 | A1* | 1/2015 | Ayasse | 166/308.1 |

FOREIGN PATENT DOCUMENTS

GB 2512122 A * 9/2014 ..... E21B 43/24

OTHER PUBLICATIONS

PCT International Search Report, Application No. PCT/US2013/027859 dated May 3, 2013.

* cited by examiner

*Primary Examiner* — Giovanna C Wright

(57) ABSTRACT

A method of producing hydrocarbons from a tight formation includes injecting a fluid, such as a miscible gas, and retrieving the hydrocarbons. The fluid may be injected into an injection fracture via and retrieved from a recovery fracture. The injection fracture and recovery fractures may be in the same wellbore, the injection fracture may be in a first wellbore and the recovery fracture in a second wellbore, or the injection fracture and recovery fracture may be in a first wellbore and additional injection or recovery fractures may be in a second wellbore.

13 Claims, 3 Drawing Sheets

FLUID INJECTION IN LIGHT TIGHT OIL RESERVOIRS

CROSS-REFERENCE TO RELATED APPLICATIONS

This application claims the benefit of U.S. Provisional Application No. 61/605,589, filed Mar. 1, 2012, which is incorporated herein by reference.

FIELD OF THE INVENTION

The invention relates to methods of producing hydrocarbons from a subsurface formation. More specifically, the invention relates to the production of hydrocarbons from a tight formation by injecting a fluid, such as a miscible gas, into an injection fracture and retrieving hydrocarbons from a of recovery fracture.

BACKGROUND

The production of hydrocarbons from some reservoirs has been difficult. In particular, "light tight oil" may be difficult to extract due to low formation permeability. For example, tight oil might be trapped in shale formations, which have low porosity and low permeability.

Some attempts to recover hydrocarbons from reservoirs have involved flooding, using water, steam, or carbon dioxide. However, such techniques have not widely been used for recovery of light tight oil. Such flooding may involve moving the oil toward a collection conduit, such as a production well, borehole, or fracture connected to a borehole. A sweep fluid may be injected into an injection well for production via different well(s). The wells may be completed with a single vertical fracture.

The injection of steam or hot gas has been used in heavy oil production. The steam heats the heavy oil, reducing viscosity and allowing the oil to flow from the formation.

U.S. Pat. No. 3,938,590 describes a process of introducing an oxidizing gas into a zone of increased gas permeability causing a reaction to occur, then introducing an alkalinity agent, then introducing steam in either a push-pull process or a multi-well throughput process of recovering petroleum.

U.S. Pat. No. 5,131,471 describes introduction of a heating drive fluid into a formation and simultaneous flow of a produced fluid from the formation in a single wellbore. The drive fluid exits an injection perforation and the formation fluid enters a production perforation. The production perforation is further along the wellbore than the injection perforation.

U.S. Pat. No. 5,148,869 describes the circulation of steam and a gas soluble in hydrocarbonaceous fluids into the wellbore below reservoir pressure through an upper perforated conduit of a horizontal wellbore. The steam heats the reservoir while gas enters the hydrocarbonaceous fluid, causing the hydrocarbonaceous fluids to flow around the horizontal wellbore for production by a lower conduit in the horizontal wellbore.

U.S. Pat. No. 5,503,226 describes the use of hot gas injected to heat matrix blocks and create or enlarge a gas cap, maintaining the flowing pressure in one or more production wells at a value slightly less than the free gas pressure at the gas liquid interface.

U.S. 2011/0127033 describes the use of steam injected into upper and lower fractures in a vertical wellbore prior to steam injection in the upper fracture coupled with heavy oil production from lower fractures.

SUMMARY OF THE INVENTION

A method of producing hydrocarbons from a tight hydrocarbon-bearing formation includes injecting a fluid, such as a miscible gas, and retrieving the hydrocarbons. The fluid may be injected into tight formation via an injection fracture and a mixture of injection fluid and hydrocarbon may be retrieved from a recovery fracture. The injection fracture and recovery fracture may be in the same wellbore, the injection fracture may be in a first wellbore and the recovery fracture in a second wellbore, the injection fracture and recovery fracture may be in a first wellbore and additional injection or recovery fractures may be in a second wellbore, or the injection fracture and the recovery fracture may be in first and second wellbores with additional injection or recovery fractures in either or both wellbores.

DETAILED DESCRIPTION

Many of the prior attempts at recovering hydrocarbons have drawbacks when attempted in tight reservoirs. For example, using flooding in light tight reservoirs would result in injection rates and sweep efficiencies (i.e., contact with pore space in the reservoir) that are impractically low due to the extremely low permeability. While closer spacing between injection and production wells might address injection rates and sweep efficiencies, the approach of drilling additional wells may not prove economic in reservoirs with low concentrations of producible hydrocarbons. Additionally, the flow pattern in the subsurface may be in the form of a "line source" to a "line sink." In other words, the fluids must diverge from a restricted region (e.g., the wellbore) and fan out into the bulk of the reservoir before converging to a restricted region (e.g., the other wellbore), which may not be efficient.

In light tight oil formations, the effects of gravity forces are relatively small compared to the effects of the viscous forces. Thus, it may be desirable to recover hydrocarbons from above and below an injection fracture in a vertical well, rather than limiting recovery to areas below the injection fracture. Likewise, in a horizontal well, it may be desirable to recover hydrocarbons from both sides (i.e., downhole side and uphole side) of the injection fracture, and both above and below the wellbore (i.e., the top side of the wellbore and the bottom side of the wellbore).

Steam injection has proven effective in reducing viscosity of heavy oil in permeable formations. However, light tight oil is difficult to extract because of the low permeability of the formation, not the high viscosity of the hydrocarbons. Thus, while methods suitable for extracting light tight oil may be suitable for extracting heavy oil in permeable formations, the reverse is not necessarily so.

A method of increasing hydrocarbon productivity from a relatively low permeability formation, such as a light tight formation, may involve the use of a fluid, such as a miscible gas. The fluid may be injected into an injection fracture and hydrocarbons may be retrieved from one or more recovery fractures. The injection and recovery fractures may be in separate wellbores, or may be in a single wellbore.

Figure 1:
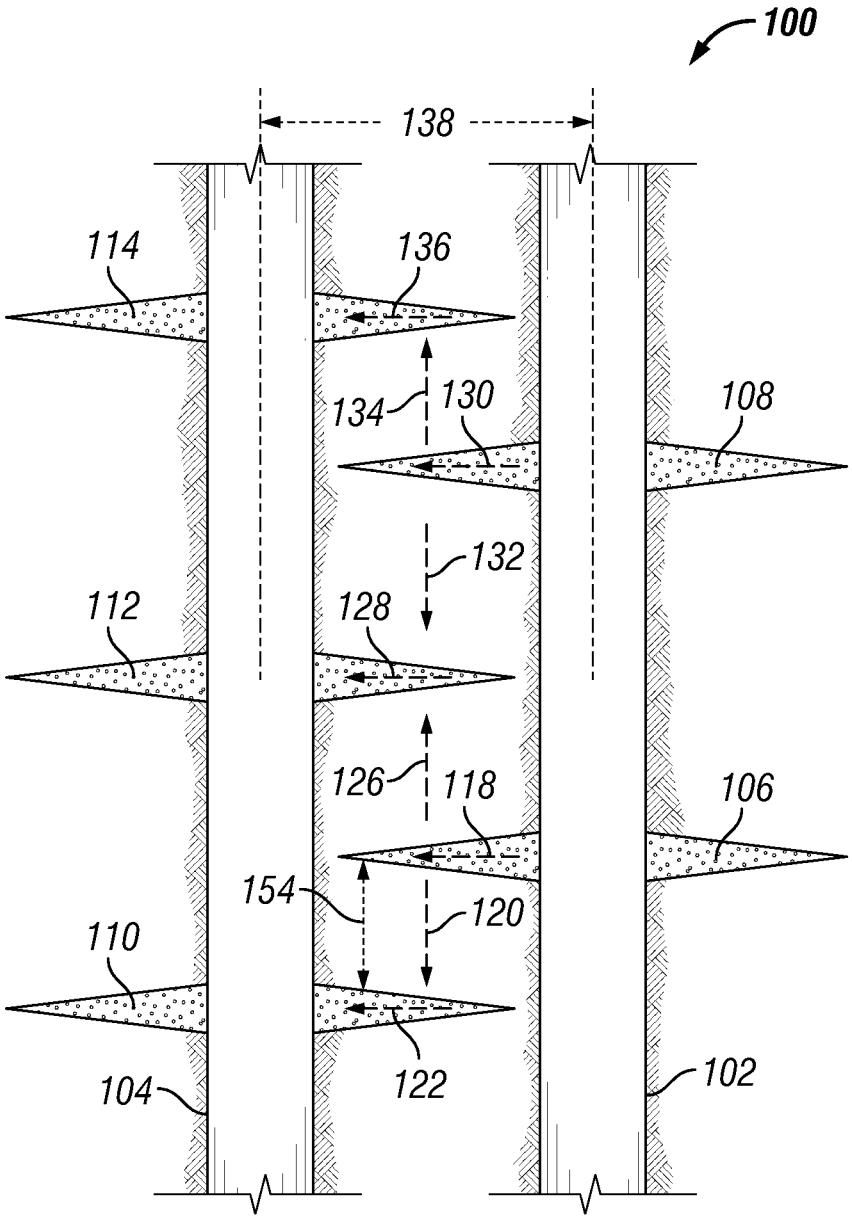
FIG. 1 is a top cross-sectional view of a first wellbore and a second wellbore having corresponding injection and recovery fractures for enhanced recovery of hydrocarbons from a formation, in accordance with one embodiment of the present disclosure.

FIG. 1 shows a top cross-sectional view of a formation 100 penetrated by a first wellbore 102 and a second wellbore 104. Each of wellbores 102 and 104 may have been previously producing wellbores and may be horizontal (as illustrated), vertical, or have some other deviation relative to the surface of the earth. The wellbores 102 and 104 may be openhole completions, or cased completions. Whether cased or not, the first wellbore 102 may have, associated therewith, an injection fracture 106, and optionally one or more additional injection fractures 108. Similarly, the second wellbore 104 may have, associated therewith, one or more recovery fractures 110 and 112, and optionally one or more additional recovery fractures 114.

Each injection fracture 106, 108 and each recovery fracture 110, 112, and 114 may be formed in a typical fracturing operation, or as part of a secondary recovery operation. These fractures may be created by a method of stimulation known as hydraulic fracturing in which fluids such as water, x-link fluids, etc. are used to create fractures in the formation rock at different points of perforation. These fluids may contain mesh size particles, known as proppant, which function to keep the fracture open and provide a permeable path for production. The injection fracture may also be formed by injecting fluid at a pressure above rock breakdown thus creating an unpropped fracture that may stay open as long as high pressure injection is sustained. When interruption of the injection is desirable for operational reasons, the restart of injection at high pressures may re-open the previous fracture or create a similar located one. The height and length of fracture are dependent on the size of the job and the stress barriers found in the formation. The length of any given fracture from wellbore to tip may be from about 100 feet up to about 1500 feet, such that the fracture measures up to about 200-3000 feet from tip to tip, with the center of wellbore intersecting the substantially planar fracture at a point near the middle of the fracture. Other ranges for the length of any given fracture from wellbore to tip may include, but are not limited to the following: about 500 feet, about 750 feet, about 1000 feet, from about 500 feet to about 1000 feet, from about 100 feet to about 500 feet, from about 1000 feet to about 1500 feet, from about 100 feet to about 750 feet, and from about 750 feet to about 1500 feet. Corresponding fractures may measure up to about double the length of any given fracture from wellbore to tip, and may include, but are not limited to the following: about 1000 feet, about 1500 feet, about 2000 feet, from about 1000 feet to about 2000 feet, from about 200 feet to about 1000 feet, from about 2000 feet to about 4000 feet, from about 200 feet to about 1500 feet, and from about 1500 feet to about 3000 feet.

In some wellbores, the injection fractures and the recovery fractures may lie substantially in a plane intersecting the respective wellbore at an approximately right angle. In other words, the ultimate or overall orientation of the fracture as it propagates into the formation may conform to the average stress of the reservoir at about 90 degrees from the direction of the borehole, even when stress fields dictate different localized fracture orientation very near the wellbore. For example, when the wellbores 102 and 104 are horizontal in the fractured zone of the formation 100, as illustrated in FIG. 1, the associated fractures 106, 108, 110, 112, and 114 may be substantially vertical. In other wellbores, the associated fractures may lie substantially in a plane parallel to the respective wellbore. Thus, for vertical wellbores (not illustrated), the fractures may also be substantially vertical, depending on the average stress in the reservoir. Regardless of the well orientation, the fractures may be located in a configuration optimal for transfer of fluid from one fracture to the next.

As illustrated, the injection fracture 106 lies between the pair of recovery fractures 110, 112, allowing for maximized communication between the injection fracture 106 and the nearest recovery fractures 110, 112. Generally, the injection fractures 106, 108 and the recovery fractures 110, 112, and 114 may have an alternating configuration, such that some or all injection fractures 106, 108 in the formation 100 are sandwiched between recovery fractures 110, 112, and 114, and vice versa. In the preferred configuration, any two injection fractures are separated from one another by a recovery fracture and any two recovery fractures are separated from one another by an injection fracture. However, groupings of injection and/or recovery fractures without alternation throughout the corresponding wellbore might be used in some instances. Thus, while many or most injection and recovery fractures may have an alternating configuration, some injection fractures may be positioned adjacent other injection fractures and some recovery fractures may be positioned adjacent other recovery fractures. The alternating configuration provides a well interconnectivity scheme allowing for more efficient use of the space in the formation, reducing the number of wells needed for similar production thresholds. In some geologies, injection and production fractures functionality may be alternated in operation sequence, so as to allow the sweep of reservoirs in both directions at various times in the life of the wells. Thus, the wells may connect through permeability streaks that may have a more efficient sweep through one of the directions of injection, due to better connection through one fracture as compared to another.

The wellbores may have spacing 138 that is only slightly greater than the length of the fractures, as measured from the wellbore of origination of the fracture to the tip, or outermost point, of the fracture. The injection fractures 106, 108 associated with the first wellbore 102 thus may extend more than halfway to the second wellbore 104, while the recovery fractures 110, 112, 114 associated with the second wellbore 104 may extend more than halfway to the first wellbore 102. Stated otherwise, the distance between the tip of the injection fracture 106 and the second wellbore 104 may be less than the distance between the tip of the injection fracture 106 and the first wellbore 102. Likewise, the distance between the tip of the recovery fracture 110 and the first wellbore 102 may be less than the distance between the tip of the recovery fracture 110 and the second wellbore 104.

The alternating configuration, coupled with the wellbore spacing 138 that allows fractures from one wellbore to have tips that extend into the fractured zone of another wellbore, may allow for a high degree of communication through the formation 100. This high degree of communication may result from enhanced effective surface area and/or decreased distance of travel from injection to recovery. In other words, the surface area of the injection fractures 106, 108 may be closely aligned with the surface area of the recovery fractures 110, 112, 114, providing a shorter average flow path between the injection fractures 106, 108 and the recovery fractures 110, 112, 114 than would be achieved without the alternating configuration or with wellbore spacing 138 whereby the fractures from one wellbore do not extend into the fractured zone of another wellbore.

The wellbores 102, 104 may each be drilled, cased, perforated, and/or fractured in accordance with any of a number of methods for wellbore completion. Hydrocarbons may then be produced via the fractures 106, 108, 110, 112, and 114 in a conventional manner. Once a production threshold is reached (for example, when the wellbores stop producing at a predetermined rate), a secondary recovery method involving injection of a fluid, such as a miscible gas, may be initiated. In one embodiment, the reservoir is depleted by long horizontal wells having multiple manmade vertical fractures regularly spaced along the horizontal section of the well and extending into the bulk of the reservoir. Alternatively, a method involving injection of a fluid, such as a miscible gas, may be initiated in conjunction with a primary recovery operation. In either case, a method of producing hydrocarbons may involve the injection of a fluid.

The fluid (e.g., miscible gas) may be injected from the surface, down through the first wellbore 102 and out into the formation 100 via the injection fracture 106, as illustrated by arrows 116 and 118. The injection of the fluid may include injection of carbon dioxide in the supercritical phase. The injection fracture 106 may be formed prior to injecting the fluid. Formation of the injection fracture 106 prior to injection of the fluid may allow for more effective placement of the injection fracture 106 in the wellbore 102. The injection fracture 106 may be formed during injection of the fluid, so long as appropriate placement of the injection fracture 106 with respect to corresponding recovery fractures 110, 112 is feasible.

Allocation of gas and fluid through each individual fracture may be done naturally (based on the injectivity of each fracture) or with inflow control valves along the injection wellbore. This may be useful when some sections of the well have poor fracture to fracture injection. For example, bad cement bonds may create sweep breakthrough, which may be corrected by closing injection for the afflicted fracture(s). Thus, gas allocation may be optimized with respect to economics and reservoir quality variations along the well, pressure gradients in the well may be balanced to minimize interference due to differential pressures, and potential cross flow may be corrected.

After the fluid has moved through the first wellbore 102 and into the formation 100 via the injection fracture 106, it may begin to move away from the injection fracture 106, causing hydrocarbons to travel (or be swept) through the formation 100 in a direction away from the injection fracture 106 and toward the recovery fractures 110 and 112, as illustrated by arrows 120 and 126. Hydrocarbons (along with some injected fluid) may then move into the recovery fractures 110 and 112, toward the second wellbore 104, as illustrated by arrows 122 and 128. The hydrocarbons may then be retrieved from the recovery fractures 110 and 112 via the second wellbore 104, as illustrated by arrow 124. When sufficient pressures are achieved via the injection of the fluid, retrieval of hydrocarbons from the second wellbore 104 may involve the upward flow of hydrocarbons and may occur without any lift assistance. In some instances, however, retrieval of hydrocarbons from the second wellbore 104 may involve the use of a pump, or other equipment used for primary and/or secondary recovery of hydrocarbons from a wellbore.

One injection fracture 106 and two recovery fractures 110 and 112 have been described above for simplicity. However, any number of additional fractures may work in conjunction with either the injection fracture 106 or the recovery fractures 110 and 112. The additional fractures 108, and 114 may provide an increase in effective surface area as compared with a single injection fracture and a pair of recovery fractures. This increase in effective surface area may allow for better recovery efficiency. For example, the first wellbore 102 may additionally or alternatively include the additional injection fracture 108 and the second wellbore 104 may include the additional recovery fracture 114, allowing for injection of fluid into multiple injection fractures via the first wellbore 102, movement of hydrocarbons away from the injection fractures 106 and 108 of the first wellbore 102 and toward the recovery fractures 110, 112, and 114 of the second wellbore 104, and retrieval of the hydrocarbons from multiple recovery fractures 110, 112, and 114 in the second wellbore 104. Thus, in the configuration illustrated in FIG. 1, fluid enters the first wellbore 102, moves into the injection fractures 106, 108, moves into the formation 100 via the injection fractures 106, 108, as illustrated by arrows 118 and 130. Miscible flooding is thought to increase oil recovery potential via mechanisms other than those associated with immiscible-type like pressure maintenance and piston-like oil displacement. These additional mechanisms are thought to result from induced oil swelling, viscosity reduction, lower or zero expected residual oil saturation and minimization of relative permeability effects due to decreased interfacial tension. The hydrocarbons in the formation 100 move away from the injection fractures 106, 108 toward the recovery fractures 110, 112, and 114 of the second wellbore 104, as illustrated by arrows 120, 126, 132, and 134. The hydrocarbons from the formation 100 move through the recovery fractures 110, 112, and 114 toward the second wellbore 104, as illustrated by arrows 128, and 136. The hydrocarbons then flow out of the recovery fractures 110, 112, and 114, through the second wellbore 104 and to the surface for collection.

While five fractures in two wellbores are illustrated in FIG. 1, any number of fractures may be used with the methods described herein, including additional fractures in any number of additional wellbores. For example, a third wellbore (not illustrated) could be provided next to the first wellbore 102 on a side opposite the second wellbore 104. Such a third wellbore may work in a manner similar to the second wellbore 104, and hydrocarbons may be retrieved therefrom. Alternatively, in a multiple step process the third wellbore could be used for injection while the first wellbore 102 could be used for retrieving hydrocarbons, then the first wellbore 102 could be used for injection while the second wellbore 104 could be used for retrieving hydrocarbons. Thus, a given wellbore may be used for injection of fluid, such as a miscible gas, at one time and retrieval of hydrocarbons at another. Similarly, any of the fractures may be considered an injection fracture or a recovery fracture, depending on the direction of fluid flow therethrough. Additionally, while the first wellbore 102 and the second wellbore 104 are illustrated as being associated with parallel horizontal wells, with the first wellbore 102 being for injection and the second wellbore 104 being for recovery, other configurations of wellbores may also be suitable, including those that are not horizontal (e.g., vertical wells, inverted wells, or wells having other angular configurations), and those that are not parallel, so long as the fractures are configured with an enhanced surface area, allowing for an improved recovery efficiency.

An advantage of the methods described herein include allowing for an economical spacing of wellbores. For example, the first wellbore 102 and the second wellbore 104 may be from about 100 to about 1500 feet apart, depending on the fracture half-length, illustrated by dimensional arrow 138.

The fracture half-length may fall within any of a number of ranges, such as those described above with respect to the length of a given fracture from wellbore to tip. Accordingly, the spacing between the first wellbore 102 and the second wellbore 104 may be equal to or slightly greater than the fracture length from wellbore to tip. Such spacing between the first wellbore 102 and the second wellbore 104 may be advantageous because it may provide a more economical development of a field, and may mitigate environmental surface impact. In dual completions, or completions where the injection fractures and the recovery fractures are associated with the same wellbore (described in detail with respect to FIG. 2 below), the spacing between wellbores might be up to 10,000 feet. Such spacing between multiple dual completion wells may be advantageous in certain applications (e.g., highly permeable formations), allowing for a reduction in capital expenditure in exchange for delayed production.

The injection fracture 106 and the recovery fractures 110 and 112, along with additional fractures 108 and 114 are illustrated in FIG. 1 as originating in separate wellbores 102, 104. However, as described with respect to FIG. 2, the injection fracture 106 and the recovery fractures 110 and 112 may be situated in a single wellbore 140.

Figure 2:
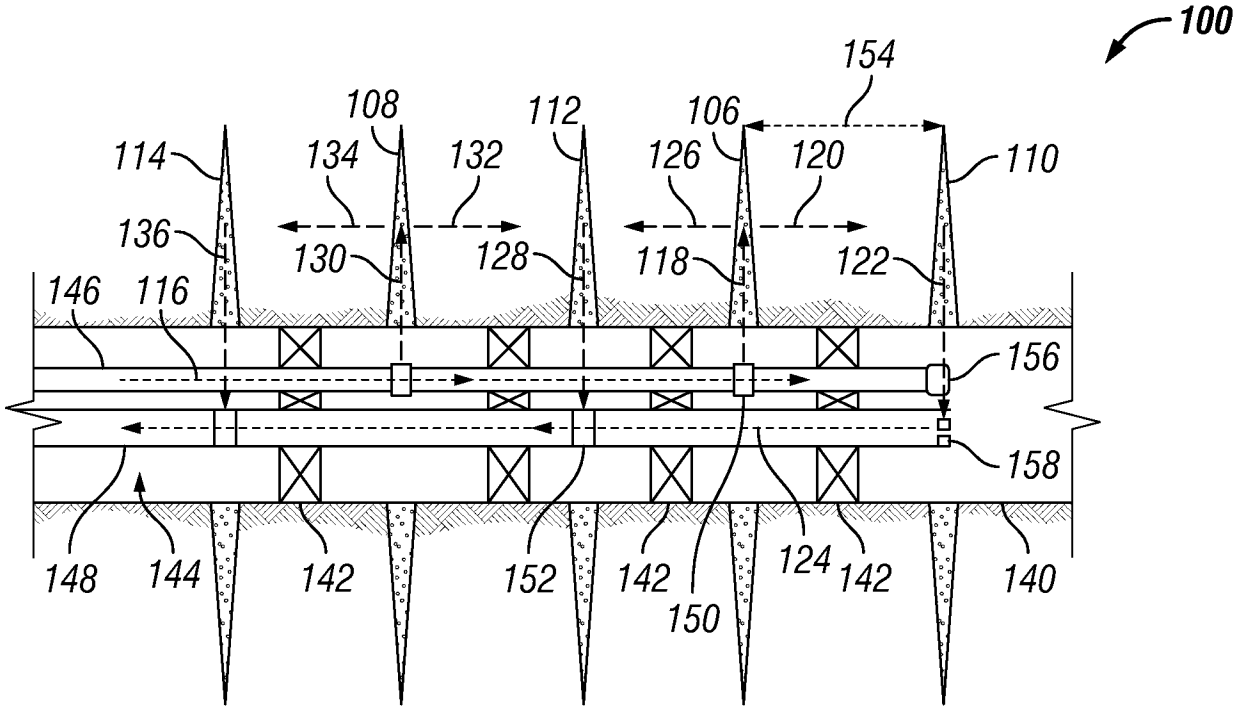
FIG. 2 is a top cross-sectional view of a single wellbore having injection and recovery fractures for enhanced recovery of hydrocarbons from a formation, in accordance with one embodiment of the present disclosure.

Referring now to FIG. 2, so long as isolation is provided between injection zones and recovery zones, the injection fracture 106 and the recovery fractures 110 and 112 may originate in the same wellbore 140. The methods for producing hydrocarbons from the formation 100 may be substantially the same for the single wellbore 140 as for the first and second wellbores 102, 104. The fluid (e.g., miscible gas) may be injected through the single wellbore 140 and out into the formation 100 via the injection fracture 106, as illustrated by arrows 116 and 118. The injection of fluid may cause the hydrocarbons to move through the formation 100 in a direction away from the injection fracture 106 and toward the recovery fractures 110 and 112, as illustrated by arrows 120 and 126. The hydrocarbons may then move into the recovery fractures 110 and 112, toward the same wellbore 104, as illustrated by arrows 122 and 128. The hydrocarbons may then be retrieved from the recovery fractures 110 and 112, as illustrated by arrow 124. The single wellbore 140 may be a horizontal wellbore, with at least one of the injection fracture 106 and the recovery fractures 110 and 112 being initiated therein or originating therefrom and having a substantially vertical orientation.

When the both the injection fracture 106 and the recovery fractures 110 and 112 originate in the single wellbore 140, wellbore isolation may be provided between the injection fracture 106 and the recovery fractures 110 and 112 prior to injecting the miscible gas or other fluid. Isolation may be provided in the form of a set of packers 142 provided in an interior of the single wellbore 140 to seal off one or more injection zones and one or more recovery zones. A dual-completion tubing 144 may be installed prior to injecting the fluid. As illustrated, the dual-completion tubing 144 may be run into the single wellbore 140 and the packers 142 may be set on either side of the fractures 106, 110, and 112. The dual-completion tubing 144 may have a first conduit 146 and a second conduit 148, the conduits 146 and 148 being isolated from one another. The first conduit 146 and the second conduit 148 may each be 2⅞" pipe for use in a 9⅝" production casing, 2⅜" pipe for use in a 7" casing, or other sizes suitable for the particular application. Landing nipples 156, 158 may be used to set plugs to isolate the respective conduits 146, 148, for instance to perform pressure testing. In some instances, the packers 142 are set by pressure, in which case, a plug may be set at the landing nipple and the corresponding conduit may be pressurized to operate the corresponding packer or packers 142. In the case of the injection conduit (illustrated as conduit 146 in FIG. 2), the landing nipple 156 may provide a way to set up a plug in the injection string, thereby isolating it from the production string (illustrated as conduit 148 in FIG. 2).

Once in place, the first conduit 146 may fluidly communicate with the zone associated with the injection fracture 106 and the second conduit 148 may fluidly communicate with the zones associated with the recovery fractures 110 and 112. This communication may be provided via sliding sleeves 150, 152, rupture disks (not shown), a side sliding door operated with coiled tubing, inflow control valve, or otherwise selectively providing an opening in the walls of the conduits 146, 148. Thus, the zone associated with the injection fracture 106 may be isolated from the zones associated with the recovery fractures 110 and 112, while both zones may be in communication with the surface via the respective conduit of the dual-completion tubing 144.

Once the dual-completion tubing is in place with the appropriate isolation, the fluid (e.g., miscible gas) may be injected via the first conduit 146 of the dual-completion tubing 144. The fluid flows through the first conduit 146 into the injection fracture 106, as illustrated by arrows 116 and 118. The fluid then passes from the injection fracture 106 into the formation 100 and toward the recovery fractures 110, and 112, as illustrated by arrows 120 and 126, moving hydrocarbons from the formation 100 into recovery fractures 110 and 112, to the second conduit 148 of the dual-completion tubing 144 for recovery via dual-completion tubing 144 to the surface, as illustrated by arrows 122, 128, and 124. The fluid may be injected through any number of injection fractures, either simultaneously, separately, or in groups. Likewise, the hydrocarbons may be recovered from any number of recover fractures, either simultaneously, separately, or in groups. Thus, methods of enhanced recovery may involve multiple stages with movement along the wellbore between the stages. In some instances, the packers 142 may be moved along a horizontal wellbore from the deepest fractures to the shallowest fractures. Once carbon dioxide breakthrough is observed, the packers 142 may be retrieved and set up in a shallower part of the well for recovery purposes. As illustrated, the dual completion may have more than injection and/or more than one production, by allocating multiple packers along the wellbore. In cases of very long horizontal wellbores, were installation and operation of many packers may be difficult or risky, this scheme can be done with some of the fractures landing in the toe of the well. When productivity is declined in this section, then recompletion may be done higher up in batches up to achieve the heal of the lateral. In this configuration the reversal of the sweep may also be advantageous as indicated in the configuration in FIG. 1.

FIG. 1 illustrates an embodiment with the injection fractures 106 and 108 in the first wellbore 102 and the recovery fractures 110, 112, and 114 in the second wellbore 104. FIG. 2 illustrates an embodiment with the injection fracture 106 and the recovery fractures 110 and 112 in the single wellbore 140. In other embodiments (not illustrated) a combination of features of these embodiments may be used. For example, the injection fracture 106 and the recovery fracture 114 could be provided in the first wellbore 102, while the injection fracture 108 and the recovery fractures 110 and 112 could be provided in the second wellbore 104. Any of other combinations might also be used, so long as at least one injection fracture lies proximate at least one recovery fracture. Preferably, at least one injection fracture lies between a pair of recovery fractures. In other words, in one exemplary embodiment, at least one pair of recovery fractures has one and only one injection fracture lying therebetween. It is also preferable that each injection fracture is separate from each recovery fracture, preventing flow of fluid immediately from fracture to fracture without sweeping hydrocarbons.

Fluids for injection into the injection fracture 106 may be any of a number of fluids or other sweeping media useful for enhanced recovery. For example, the fluid may include liquids or gases such as, but not limited to, methane, nitrogen, propane, liquefied petroleum gas, carbon dioxide, other miscible fluids, and flue gases. In particular, the fluid may be a miscible gas such as carbon dioxide.

The wellbores of FIGS. 1 and 2 are illustrated as being substantially horizontal with substantially vertical fractures, but could be substantially vertical wellbores or wellbores having any deviation or angular orientation with corresponding fractures extending substantially orthogonally or otherwise therefrom. The terms "horizontal" and "vertical" are used to refer to wellbores and fractures having a substantially horizontal or a substantially vertical orientation in the region or zone of interest, and may include wellbores deviating from absolute horizontal and absolute vertical by some degree.

Any or all fractures described herein may be manmade. In other words, the fractures 106, 108, 110, 112, 114 may be initiated by human interaction with the formation 100. Manmade fractures may be created by any of a number of techniques, including, but not limited to, explosives, acidizing, mechanically cutting, drilling, and hydraulic fracturing. While hydraulic fracturing is a popular method of fracturing, the advantages of the methods disclosed herein are not limited to fractures formed via hydraulic fracturing. Fractures may provide a long reach into the bulk of the reservoir and may have a substantially planar shape. The use of manmade fractures provides an intentionally designed spacing for a tailored efficiency and reservoir flow characteristics.

The recovery fractures 110 and 112 and/or the injection fracture 106 may both initially be formed as hydrocarbon recovery fractures in conjunction with primary hydrocarbon recovery operations. Well completion may be completed in conjunction with the primary hydrocarbon recovery operation, and may involve drilling the wellbore(s), running casing, perforating, and fracturing. Once a certain level of hydrocarbon depletion has occurred, some of the fractures initially used for primary recovery may be repurposed as injection fractures for secondary recovery. Thus, the injection fracture 106 and/or the recovery fractures 110 and 112 may be formed for a primary recovery operation and may be present prior to injecting the fluid for a secondary recovery operation. Alternatively, the injection fracture 106 and the recovery fractures 110 and 112 may be formed for the purpose of use in injection and recovery, respectively, in a primary recovery operation. The injection fracture 106 and/or the recovery fractures 110 and 112 may be formed via any of the fracturing methods described above. Whether formed for primary recovery operations or for secondary recovery operations, the recovery fractures 110 and 112 and/or the injection fracture 106 may be created prior to injecting the fluid. If not already formed, the injection fracture 106 may be formed by the injection of the fluid.

Spacing between the fractures may be measured from the primary plane of one fracture to the primary plane of another fracture, which may not be the shortest distance between the two fractures. Thus, the fracture spacing may not be dependent on the number of wellbores. For example, the distance between the injection fracture 106 and the recovery fracture 110 is represented by the dimensional arrow 154 in both FIG. 1 and FIG. 2. The injection fracture 106 and the recovery fracture 110 may be spaced 50 to 500 feet apart. More specifically, the injection fracture 106 and the recovery fracture 110 may be spaced 75 to 150 feet apart, 100 to 125 feet apart, approximately 120 feet apart, or any other distance suitable for providing suitable production in a cost-effective manner. The spacing between injection fracture 106 and recovery fracture 110 is exemplary and similar spacing may be used between any injection fracture and any recovery fracture.

Figure 3:
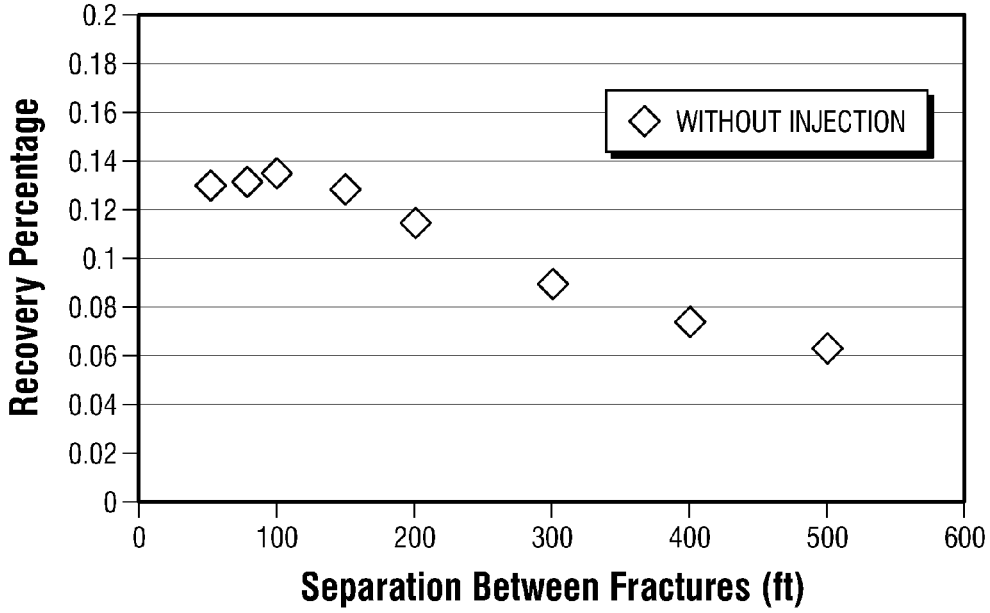
FIG. 3 is a chart showing simulated recovery percentages as a function of spacing of fractures without the use of injection fractures.
Figure 4:
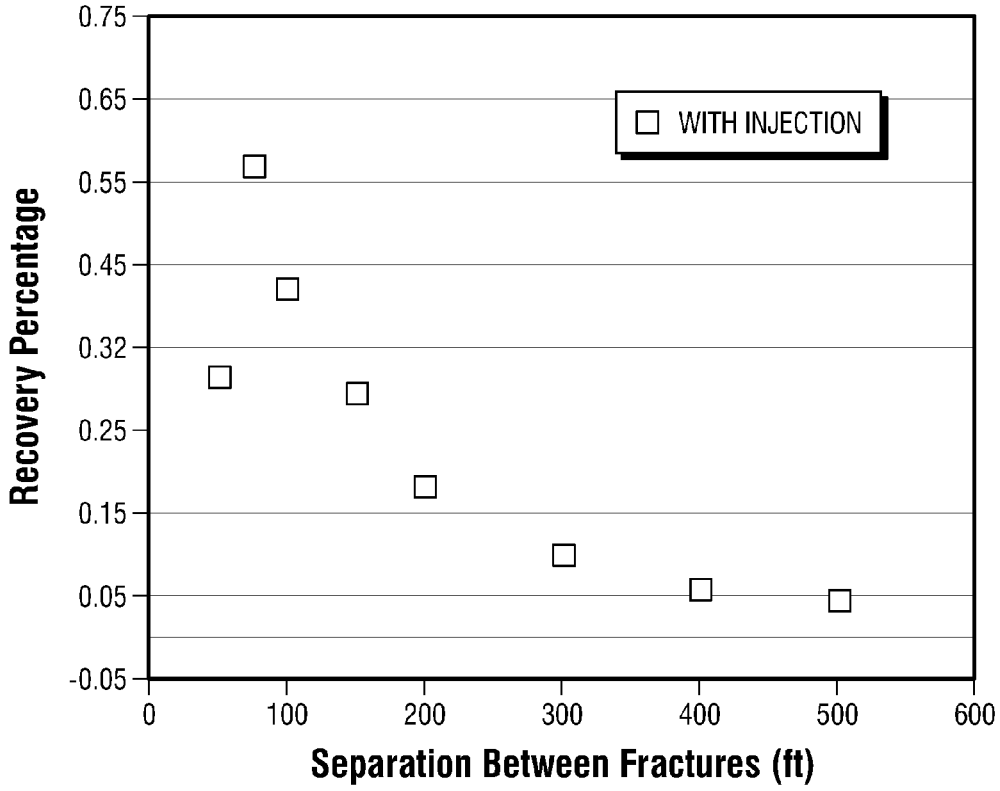
FIG. 4 is a chart showing simulated recovery percentages as a function of spacing of fractures with the use of injection fractures, in accordance with the teachings of the present disclosure.

Referring now to FIGS. 3 and 4, simulated recovery percentages as a function of spacing of the fractures are improved with the use of injection fractures. FIG. 3 illustrates recovery percentages as a function of spacing without injection fractures and FIG. 4 illustrates the same data points with injection fractures. While the actual increase in recovery would depend on reservoir properties, such as permeability and volume of dissolved gas in the oil, these simulated results indicate a significant increase in recovery percentage with the use of injection fractures, particularly when separation between fractures is from about 75 to 150 feet.

The methods described above may provide any or all of the following advantages: drilling of wills at an economically practical spacing while fluids in the reservoir flow essentially along straight lines (heterogeneity notwithstanding) so sweep efficiency may be maximized, increased efficiency in recovery of hydrocarbons in primary recovery operations, increased efficiency in recovery of hydrocarbons in secondary operations, increased recovery efficiency above what can be achieved by simple primary depletion, improved recovery of hydrocarbons in vertical wellbores, improved recovery of hydrocarbons in horizontal wellbores, the reduction or elimination of steam or hot gas in recovery operations, a reduced footprint size for a collection of injector and recovery wells, an improved effective surface area between injection and production points (wells, fractures, etc.), reduced waste in the form of targeted sweeping of the formation, the ability to recover hydrocarbons above an injection point in a vertical well, the ability to recover hydrocarbons uphole of an injection point in a horizontal well, the ability to recover hydrocarbons from a topside of a horizontal wellbore in conjunction with an injection, the ability to recover hydrocarbons while injecting, optimization of recovery in a wellbore, enabling economically enhanced recovery based on sweep in formations with excessive fingering (e.g., in short distances sweeps of 75 to 150 ft fracture to fracture, in comparison with well to well distances of 2,000 ft are more economical), enabling enhanced oil recovery in offshore platforms which may not have space for drilling extra wells for injection, and/or any of a number of other advantages.

What is claimed is:

1. A method of producing hydrocarbons from a tight formation, comprising:

injecting carbon dioxide into an injection fracture; and retrieving hydrocarbons from a recovery fracture, wherein the injection fracture and the recovery fracture originate in a horizontal wellbore and a plane of the injection fracture and a plane of the recovery fracture are separated by 50 to 500 feet and have a substantially vertical orientation.

2. The method of claim 1, wherein the fluid comprises a miscible gas.

3. The method of claim 1, wherein the injection and recovery fractures are manmade.

4. The method of claim 1, wherein the injection fracture is formed prior to injecting the fluid.

5. The method of claim 1, wherein the injection and recovery fractures are spaced 75 to 150 feet apart.

6. The method of claim 1, further comprising creating the recovery fracture prior to injecting the fluid.

7. The method of claim 1, wherein the injection fracture is associated with a first wellbore and wherein the recovery fracture is associated with a second wellbore.

8. The method of claim 7, wherein the first wellbore and the second wellbore are spaced 200 to 3000 feet apart.

9. The method of claim 1, further comprising providing wellbore isolation between the injection and recovery fractures prior to injecting the fluid.

10. The method of claim 1, further comprising installing dual-completion tubing prior to injecting the fluid.

11. The method of claim 1, wherein the hydrocarbons are light hydrocarbons.

12. The method of claim 1, comprising at least two recovery fractures, wherein the injection fracture lies between the recovery fractures.

13. The method of claim 1 wherein the carbon dioxide is supercritical carbon dioxide.

* * * * *